US009064446B2

(12) United States Patent
Teranishi et al.

(10) Patent No.: US 9,064,446 B2
(45) Date of Patent: Jun. 23, 2015

(54) DISPLAY DEVICE, METHOD OF DRIVING DISPLAY DEVICE, AND ELECTRONIC APPLIANCE

(71) Applicant: Japan Display Inc., Tokyo (JP)

(72) Inventors: Yasuyuki Teranishi, Kanagawa (JP); Takayuki Nakanishi, Kanagawa (JP); Toshihiko Tanaka, Kanagawa (JP); Hayato Kurasawa, Kanagawa (JP)

(73) Assignee: Japan Display Inc., Tokyo (JP)

( * ) Notice: Subject to any disclaimer, the term of this patent is extended or adjusted under 35 U.S.C. 154(b) by 154 days.

(21) Appl. No.: 13/741,920

(22) Filed: Jan. 15, 2013

(65) Prior Publication Data

US 2013/0229444 A1 Sep. 5, 2013

(30) Foreign Application Priority Data

Mar. 1, 2012 (JP) ..... 2012-045287

(51) Int. Cl.

| | |
|---|---|
| ***G09G 5/10*** | (2006.01) |
| ***G09G 3/20*** | (2006.01) |
| *G09G 3/36* | (2006.01) |

(52) U.S. Cl.

CPC ..... *G09G 5/10* (2013.01); *G09G 3/2022* (2013.01); *G09G 3/2074* (2013.01); *G09G 3/2077* (2013.01); *G09G 3/3648* (2013.01); *G09G 2300/0857* (2013.01); *G09G 2310/04* (2013.01); *G09G 2340/0435* (2013.01)

(58) Field of Classification Search

None

See application file for complete search history.

(56) References Cited

U.S. PATENT DOCUMENTS

| | | | | |
|---|---|---|---|---|
| 7,227,524 | B2 * | 6/2007 | Ueno et al. | 345/89 |
| 2007/0252856 | A1 * | 11/2007 | Hudson et al. | 345/693 |
| 2008/0170028 | A1 * | 7/2008 | Yoshida | 345/100 |
| 2010/0091033 | A1 * | 4/2010 | Itoyama et al. | 345/600 |

FOREIGN PATENT DOCUMENTS

| | | |
|---|---|---|
| JP | 2005-164814 | 6/2005 |
| JP | 2006-343609 | 12/2006 |
| JP | 2007-147932 | 6/2007 |
| WO | 2008/139693 | 11/2008 |

OTHER PUBLICATIONS

Japanese Office Action issued Apr. 7, 2015 in corresponding Japanese Application No. 2012-045287.

* cited by examiner

*Primary Examiner* — Joseph Haley
*Assistant Examiner* — Emily Frank
(74) *Attorney, Agent, or Firm* — K&L Gates LLP

(57) ABSTRACT

A display device in which pixels having a memory function are arranged includes a driving unit that performs display driving in a driving method that obtains a middle gradation by temporally changing gradation of each of the pixels in one period in which a plurality of frames are assumed, wherein the driving unit is configured to discontinuously write lower bits and higher bits of gradation data with respect to the pixels in a scanning direction in a unit of one line or a plurality of lines.

12 Claims, 14 Drawing Sheets

DISPLAY DEVICE, METHOD OF DRIVING DISPLAY DEVICE, AND ELECTRONIC APPLIANCE

CROSS REFERENCES TO RELATED APPLICATIONS

The present application claims priority to Japanese Priority Patent Application JP 2012-045287 filed in the Japan Patent Office on Mar. 1, 2012, the entire content of which is hereby incorporated by reference.

BACKGROUND

The present disclosure relates to a display device, a method of driving the display device, and an electronic appliance.

In a display device, as one technique to raise the number of displayable (expressible) gradations, a driving method that obtains a middle gradation by temporally changing gradations of each pixel in one period of a plurality of frames is known (for example, see Japanese Unexamined Patent Application Publication No. 2007-147932). Here, assuming the plurality of frames as one period may be considered as dividing image generation of one frame into a plurality of subframes (so-called time division driving method).

This driving method, that is, time division driving method, may also be called FRC (Frame Rate Control) driving. The FRC driving is a driving method that displays a middle gradation luminance of the plurality of gradation luminance using afterimage properties of human eyes (afterimage effect) by changing, at high speed, the different plurality of gradation luminance in a subframe unit, and can raise the number of display gradations in comparison to a normal driving that assumes one frame as one period.

SUMMARY

If the FRC driving is applied to raise the number of display gradations, a high-speed driving that corresponds to the number of frames (subframes) is necessary in comparison to a normal driving that assumes one frame as one period, and thus the situation that an operating speed of a driving unit is unable to support such high speed may occur. If the overall driving frequency is lowered to prevent the occurrence of such a situation, screen flickering becomes easily visually recognizable in the change timing of bits of gradation data.

The present disclosure has been made to meet the above requirements, and it is desirable to provide a display device, a method of driving the display device, and an electronic appliance, which can realize FRC driving while reducing screen flickering in the change timing of bits of gradation data.

According to an embodiment of the present disclosure, there is provided a display device in which pixels having a memory function are arranged and which includes a driving unit that performs display driving in a driving method that obtains a middle gradation by temporally changing gradation of each of the pixels in one period in which a plurality of frames are assumed, wherein the driving unit is configured to discontinuously write lower bits and higher bits of gradation data with respect to the pixels in a scanning direction in a unit of one line or a plurality of lines. The display device according to the embodiment is suitable to be used as a display unit in various electronic appliances.

According to another embodiment of the present disclosure, there is provided a method of driving a display device in which pixels having a memory function are arranged and which performs display driving in a driving method that obtains a middle gradation by temporally changing gradation of each of the pixels in one period in which a plurality of frames are assumed, which includes discontinuously writing lower bits and higher bits of gradation data with respect to the pixels in a scanning direction in a unit of one line or a plurality of lines.

In performing the driving method that obtains the middle gradation by temporally changing the gradation of each of the pixels in one period in which the plurality of frames are assumed, that is, in performing FRC driving, scanning is performed in the unit of one line or a plurality of lines. Further, by discontinuously writing the lower bits and the higher bits of the gradation data with respect to the pixels in the scanning direction, the change timing of the bits of the gradation data is dispersed. Accordingly, the screen flickering in the change timing of the bits of the gradation data can be reduced.

According to the present disclosure, since the change timing of the bits of the gradation data is dispersed, the FRC driving can be realized while reducing the screen flickering in the change timing of the bits of the gradation data.

Additional features and advantages are described herein, and will be apparent from the following Detailed Description and the figures.

DETAILED DESCRIPTION

Figure 1:
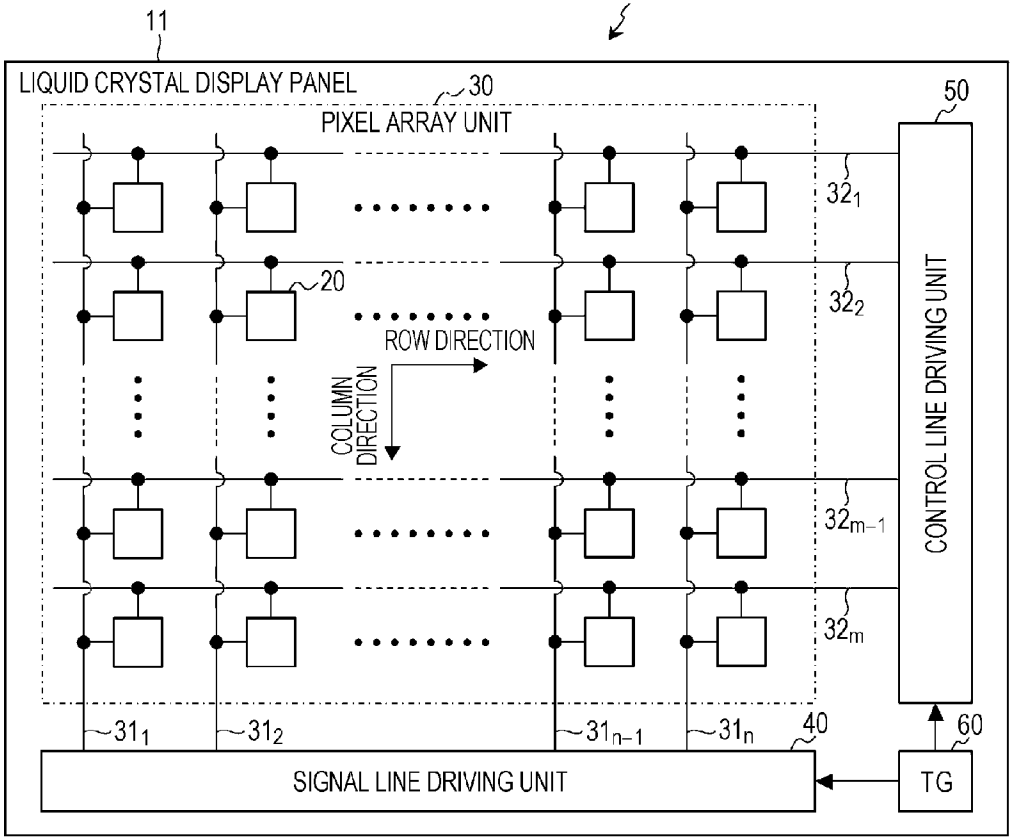
FIG. 1 is a system configuration diagram schematically illustrating the configuration of an active matrix type liquid crystal display device to which a technique of the present disclosure is applied.

Hereinafter, examples for carrying out the technique of the present disclosure (hereinafter described as "embodiments")

will be described with reference to the accompanying drawings. The present disclosure is not limited to the embodiments, and various numerical values in the embodiments are exemplary. In the following description, the same reference numerals are used for the same elements or elements having the same functions, and the duplicate description thereof will not be repeated. Further, explanation will be made in the following sequence.

1. Explanation about the whole of a display device, a method of driving the display device, and an electronic appliance according to the present disclosure
2. Display device (example of a liquid crystal display device) to which the technique of the present disclosure is applied
2-1. System configuration
2-2. MIP type pixel
2-3. Area gradation method
2-4. Area gradation+FRC driving
3. Explanation of embodiments
3-1. Reference example 1 (example of two-bit area gradation+two-bit FRC driving)
3-2. Example 1 (example of two-bit area gradation+two-bit FRC driving)
3-3. Reference example 2 (example of two-bit area gradation+one-bit FRC driving)
3-4. Example 2 (example of two-bit area gradation+one-bit FRC driving)
3-5. Example 3 (example of FRC driving of time division 1:2)
3-6. Example 4 (example of FRC driving of time division 1:4)
4. Electronic appliance
5. Configuration of the present disclosure

1. Explanation about the Whole of a Display Device, a Method of Driving the Display Device, and an Electronic Appliance According to the Present Disclosure A display device according to the present disclosure is a display device in which pixels having a memory function are arranged. As this display device, for example, a so-called MIP (Memory In Pixel) type display device having a memory unit that can store data in a pixel may be exemplified.

As the display device, an existing display device, such as an electroluminescence display device, a plasma display device, or the like, more specifically, a flat panel type display device, may be used. Here, in the case where the display device according to the present disclosure is a liquid crystal display device, a display device having a memory function in a pixel may be provided by using memory-related liquid crystals for the pixel. The display device may be a display device corresponding to monochromatic display or a display device corresponding to color display.

Since the display device having a memory function in the pixel can store data in the pixel, it may realize a display in an analog display mode and a display in a memory display mode through a mode change switch. Here, "analog display mode" is a display mode in which the gradation of the pixel is analogously displayed. Further, "memory display mode" is a display mode in which the gradation of the pixel is digitally displayed based on two-value data (logic "1"/logic "0") stored in the pixel.

In the display device having a memory function in a pixel, for example, in the MIP type display device, since the circuit scale that is built in the pixel is limited due to the limitations of resolution, the number of display gradation tends to decrease. Accordingly, in the MIP type display device, the display driving is performed through the FRC driving that obtains the middle gradation by assuming a plurality of frames as one period, dividing one-frame image generation into a plurality of subframes, and temporally changing the gradation of each pixel in the one period (one-frame image generation period).

As described above, the "FRC driving" is a driving method that displays a middle gradation luminance of a plurality of gradation luminance using afterimage properties of human eyes (afterimage effects) by changing, at high speed, the different plurality of gradation luminance in a subframe unit. Here, the "subframe" means each frame when the plurality of frames are assumed one period (one-frame image generation period). By performing the FRC driving, the number of displayable (expressible) gradations is raised in comparison to the driving in the unit of a frame that assumes one frame as one period (one-frame image generation period).

As described above, a display device, a method of driving the display device, and an electronic appliance according to the present disclosure assume the configuration in which pixels having a memory function are arranged and display driving is performed through the FRC driving. In performing the display driving through the FRC driving, writing of lower bits and higher bits of gradation data is discontinuously performed with respect to the pixels in a scanning direction in a unit of one line or a plurality of lines.

As described above, by discontinuously writing the lower bits and the higher bits of the gradation data with respect to the pixels in the scanning direction, the change timing of the bits of the gradation data is dispersed, and thus the screen flickering in the change timing of the bits of the gradation data can be reduced. Accordingly, the FRC driving can be realized while the screen flickering in the change timing of the bits of the gradation data can be reduced.

Further, the display device, the method of driving the display device, and the electronic appliance according to the present disclosure, which include the above-described preferable configuration, may be configured to insert writing of other data of the lower bits and the higher bits before finishing writing of entire lines with respect to one side of data of the lower bits and the higher bits.

At this time, it is preferable to perform writing of the one side of data of the lower bits and the higher bits by interlaced scanning in a unit of one line or a plurality of lines and then to perform writing of other data of the lower bits and the higher bits by interlaced scanning with respect to the same lines as the one side of data. Further in the following scanning, it is preferable to sequentially perform writing of the one side of data and other data by interlaced scanning with respect to the interlaced lines.

On the other hand, the display device, the method of driving the display device, and the electronic appliance according to the present disclosure, which include the above-described preferable configuration, may be configured to perform discontinuous writing of one side of data of the lower bits and the higher bits in a certain frame in the scanning direction and to perform discontinuous writing of other data of the lower bits and the higher bits in a next frame in the scanning direction.

At this time, it is preferable to first perform writing of the respective data of the lower bits and the higher bits in one frame by interlaced scanning with respect to an odd-numbered line or an odd numbered-line group and then to perform writing by interlaced scanning with respect to an even-numbered line or an even-numbered line group.

In the MIP type display device, only two gradations can be expressed by one bit for each pixel. Because of this, in driving the pixel, in the gradation expression method, it is preferable that one pixel is composed of a plurality of sub-pixels, and an area gradation method that displays the gradation by a combination of areas of electrodes of the plurality of sub-pixels is used.

Here, the "area gradation method" is a gradation expression method that expresses $2^N$ gradations by N sub-pixel electrodes to which the heaviness that corresponds to an area ratio, that is such as $2^0$, $2^1$, $2^2$, . . . , and $2^{N-1}$, is applied. This area gradation method is adopted for the purpose of improving the non-uniformity of a picture quality due to the characteristic deviation of TFT (Thin Film Transistor) that constitutes a pixel circuit.

In pixel electrodes of a pixel that is driven by the area gradation method, it is preferable that a pixel electrode of the pixel is divided into a plurality of electrodes for the plurality of sub-pixels, and the gradation display is performed by a combination of areas of the plurality of electrodes. At this time, it is preferable that the plurality of electrodes include three electrodes, and the gradation display is performed by a combination of areas of the middle electrode and the two electrodes across the middle electrode. Further, it is preferable that the two electrodes, between which the middle electrode is inserted, are electrically connected to each other and are configured to be driven by one driving circuit.

2. Display Device to which the Technique of the Present Disclosure is Applied Before describing embodiments of the present disclosure, a display device to which the technique according to the present disclosure is applied will be described. Here, as the display device to which the technique according to the present disclosure is applied, an active matrix type liquid crystal display device will be described as an example. However, the display device to which the technique according to the present disclosure is applied is not limited thereto.

2-1. System Configuration

FIG. 1 is a system configuration diagram schematically illustrating the configuration of an active matrix type liquid crystal display device to which a technique of the present disclosure is applied. The liquid crystal display device has a panel structure in which two sheets of substrate (not illustrated), at least one of which is transparent, are arranged to face each other at a predetermined interval and liquid crystals are enclosed between the two sheets of substrate.

The liquid crystal display device 10 according to the present disclosure is configured to have a pixel array unit 30 in which a plurality of pixels 20 that include liquid crystal capacity are two-dimensionally arranged in the form of a matrix, and a driving unit arranged in the vicinity of the pixel array unit 30. The driving unit includes a signal line driving unit 40, a control line driving unit 50, and a drive timing generation unit 60, and for example, the driving unit is integrated on the same liquid crystal display panel (substrate) 11 as the pixel array unit 30 to drive respective pixels 20 of the pixel array unit 30.

Here, in the case where the liquid crystal display device 10 supports color display, one pixel is composed of a plurality of sub-pixels, and the respective sub-pixels correspond to a pixel 20. More specifically, in the liquid crystal display device for color display, one pixel includes three sub-pixels of red (R) light, green (G) light, and blue (B) light.

However, one pixel is not limited to a combination of sub-pixels of three primary colors of RGB, but it is also possible to configure one pixel by adding one color or sub-pixels of a plurality of colors to the sub-pixels of the three primary colors. More specifically, for example, it is also possible to configure one pixel through addition of a sub-pixel of white light in order to improve the luminance, or to configure one pixel through addition of at least one sub-pixel of complementary color light in order to expand the color reproduction range.

The liquid crystal display device 10 according to the present disclosure is configured to correspond to both the display in an analog display mode and the display in a memory display mode using a pixel having a memory function as the pixel 20, for example, an MIP type pixel including a memory unit that can memorize data for each pixel. In the liquid crystal display device 10 using the MIP type pixels, a constant voltage is continuously applied to the pixel 20, and thus a problem of shading depending on a diachronic voltage change by light leakage of a pixel transistor can be solved.

In FIG. 1, with respect to the pixel array with m rows and n columns of the pixel array unit 30, signal lines $\mathbf{31}_1$ to $\mathbf{31}_n$ (hereinafter, may be merely described as "signal line 31") are wired for each pixel column along the column direction. Further, control lines $\mathbf{32}_1$ to $\mathbf{32}_m$ (hereinafter, may be merely described as "control line 32") are wired for each pixel row along the row direction. Here, the "column direction" means an array direction (that is, vertical direction) of pixels of the pixel column, and the "row direction" means an array direction (that is, horizontal direction) of pixels of the pixel row.

Each end of the signal line 31 ($\mathbf{31}_1$ to $\mathbf{31}_n$) is connected to each output terminal that corresponds to the pixel column of the signal line driving unit 40. The signal line driving unit 40 operates to output a signal potential (analog potential in an analog display mode and two-value potential in a memory display mode) that reflects a certain gradation to the corresponding signal line 31. Further, in the case of replacing the logic level of the signal potential that is maintained in the pixel 20, for example, even in the memory display mode, the signal line driving unit 40 operates to output the signal potential to the signal line 31 that corresponds to the signal potential that reflects necessary gradation.

In FIG. 1, the control lies $\mathbf{32}_1$ to $\mathbf{32}_m$ are shown as one wiring, but are not limited to one wiring. Actually, the control lines $\mathbf{32}_1$ to $\mathbf{32}_m$ are composed of a plurality of wirings. Each end of the control lines $\mathbf{32}_1$ to $\mathbf{32}_m$ is connected to each output terminal that corresponds to the pixel row of the control line driving unit 50. For example, in the analog display mode, the control line driving unit 50 performs control of a write operation of the signal potential which reflects the gradation with respect to the pixel 20 and is output from the signal line driving unit 40 to the signal lines $\mathbf{31}_1$ to $\mathbf{31}_n$.

The driving timing generation unit (TG: Timing Generator) 60 generates various driving pulses (timing signals) for driving the signal line driving unit 40 and the control ling driving unit 50 and supplies the driving pulses to the driving units 40 and 50.

2-2. MIP Type Pixel

Then, the MIP type pixel, which is used as the pixel 20, will be described. The MIP type pixel is configured to correspond to both the display in the analog display mode and the display in the memory display mode. As described above, the analog display mode is a display mode in which the pixel gradation is analogously displayed. Further, the memory display mode is a display mode in which the pixel gradation is digitally displayed based on two-value information (logic "1"/"0") stored in the memory in the pixel.

In the memory display mode, it is not necessary to execute the writing operation of the signal potential that reflects the gradation in the frame period in order to use information that is maintained in the memory unit. Because of this, in the case of the memory display mode, the power consumption is decreased in comparison to the analog display mode in which it is necessary to perform the writing operation of the signal potential that reflects the gradation in a frame period. In other words, the low power consumption of the display device can be sought.

Figure 2:
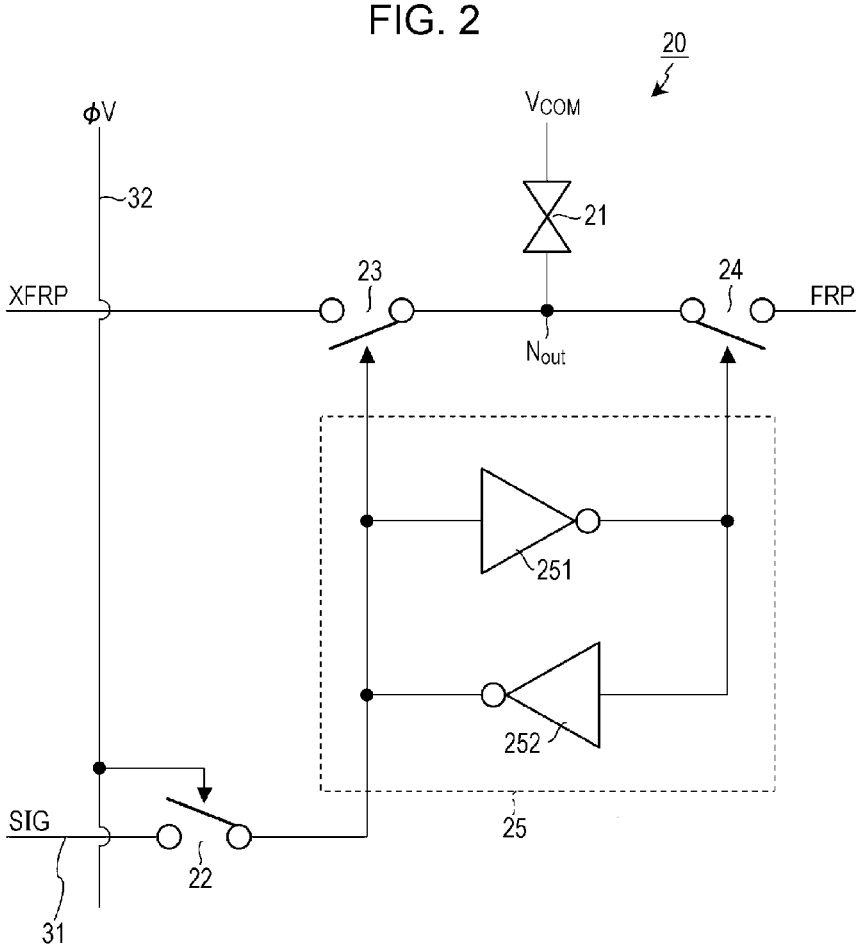
FIG. 2 is a block diagram illustrating an example of the circuit configuration of an MIP type pixel.
Figure 3:
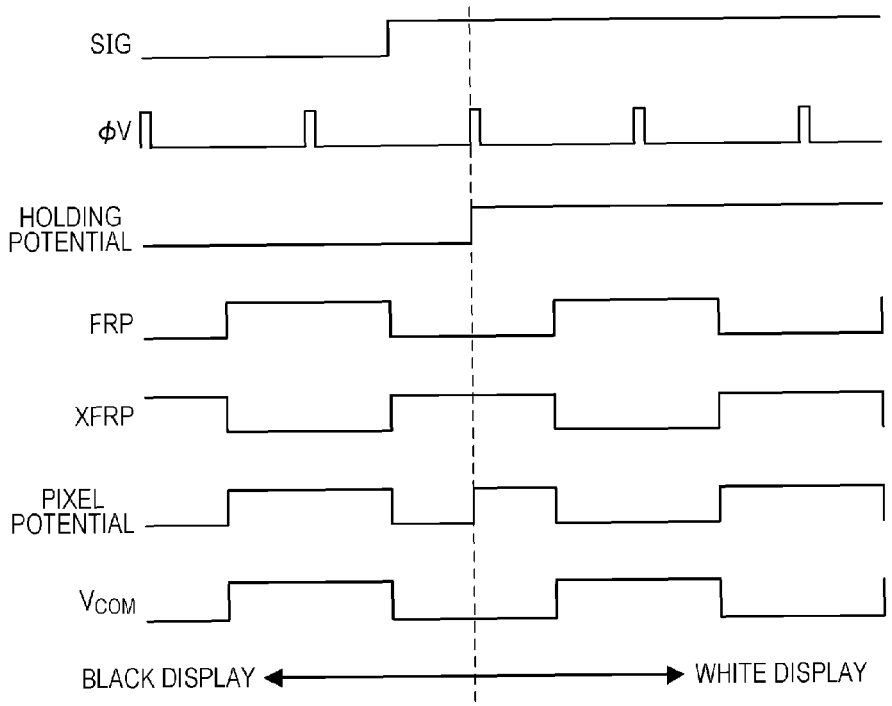
FIG. 3 is a timing chart provided to explain the operation of an MIP type pixel.

FIG. 2 is a block diagram illustrating an example of a circuit configuration of the MIP type pixel 20. Further, FIG. 3 illustrates a timing chart provided to explain the operation of the MIP type pixel 20.

Although illustration is omitted for the simplification of the drawing, the pixel 20 is configured, for example, to have a pixel transistor composed of a thin film transistor (TFT) and holding capacity in addition to liquid crystal capacity 21. The liquid crystal capacity 21 means a capacity component of a liquid crystal material that occurs between the pixel electrode and a facing electrode that is formed to face the pixel electrode. A common voltage $V_{COM}$ is applied to the facing electrode of the liquid crystal capacity 21 as the common voltage for the whole pixel.

Further, the pixel 20 is configured as an SRAM function pixel having three switch elements 22 to 24 and a latch unit 25. The switch element 22 is connected to one end of the signal line 31 (corresponding to signal lines $\mathbf{31}_1$ to $\mathbf{31}_n$ of FIG. 1). The switch element 22 is in an ON (OFF) state by giving a scanning signal (ϕV from the control line driving unit 50 of FIG. 1 through the control line 32 (corresponding to control lines $\mathbf{32}_1$ to $\mathbf{32}_m$ of FIG. 1), and receives data SIG that is supplied from the signal line driving unit 40 of FIG. 1 through the signal line 31. In this case, the control line 32 becomes the scanning line. The latch unit 25 is configured by inverters 251 and 252 that are connected in parallel in reverse direction, and maintains (latches) the potential according to the data SIG received by the switch element 22.

To the terminals of respective sides of the switch elements 23 and 24, a voltage FRP that has the same phase as the common voltage $V_{COM}$ and a voltage XFRP that is a reverse phased voltage are given. The terminals of the other sides of the switch elements 23 and 24 are commonly connected to become an output node $N_{out}$ of the pixel circuit. Any one of the switch elements 23 and 24 is in an ON state depending on the polarity of the holding potential of the latch unit 25. Through this, the voltage FRP having the same phase or the voltage XFRP having the reverse phase is applied to the pixel electrode of the liquid crystal capacity 21, to which the common voltage $V_{COM}$ is applied.

As is clear from FIG. 3, in the case of a normal black (black display when no voltage is applied) liquid crystal panel, if the holding potential of the latch unit 25 has a negative polarity, the pixel potential of the liquid crystal capacity 21 has the same phase as the common voltage $V_{COM}$, and it becomes the black display. Further, if the holding potential of the latch unit 25 has a positive polarity, the pixel potential of the liquid crystal capacity 21 has the reverse phase to the common voltage $V_{COM}$, and it becomes the white display.

As is clear from the above description, in the MIP type pixel 20, any one of the switch elements 23 and 24 is turned on depending on the polarity of the holding potential of the latch unit 25, and the voltage FRP having the same phase or the voltage XFRP having the reverse phase is applied to the pixel electrode of the liquid crystal capacity 21. Through this, as described above, a constant voltage is continuously applied to the pixel 20, and there is not the concern that shading occurs.

Figure 4:
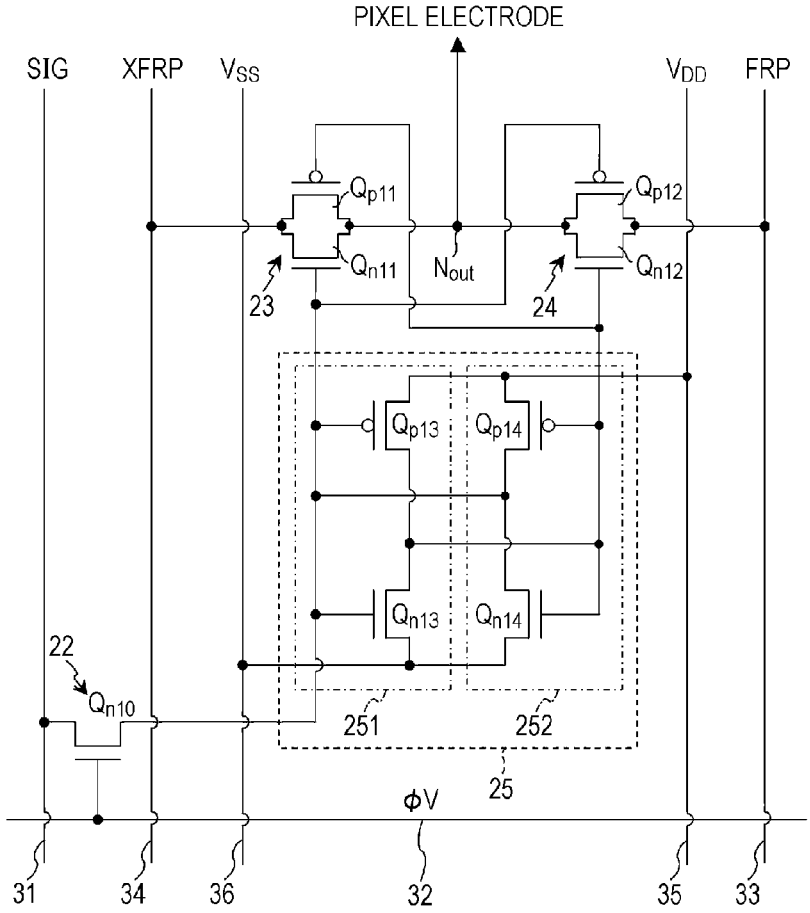
FIG. 4 is a circuit diagram illustrating a specific example of the circuit configuration of a pixel of an MI type.

FIG. 4 is a circuit diagram illustrating an example of the concrete circuit configuration of the pixel 20. In the drawing, the same reference numerals are given to the portions that correspond to FIG. 2.

In FIG. 4, the switch element 22 includes, for example, an NchMOS transistor $Q_{n10}$. One side of source/drain electrodes of the NchMOS transistor $Q_{n10}$ is connected to the signal line 31, and a gate electrode thereof is connected tot the control line (scanning line) 32.

Both the switch elements 23 and 24 are transfer switches in which an NchMOS transistor and a PchMOS transistor are connected in parallel. Specifically, the switch element 23 has a configuration in which an NchMOS transistor $Q_{n11}$ and a PchMOS transistor $Q_{p11}$ are connected in parallel. The switch element 24 has a configuration in which an NchMOS transistor $Q_{n12}$ and a PchMOS transistor $Q_{p12}$ are connected in parallel.

It is not necessary that the switch elements 23 and 24 are transfer switches in which an NchMOS transistor and a PchMOS transistor are connected in parallel. That is, it is also possible to configure the switch elements 23 and 24 using single conduction type MOS transistors, that is, NchMOS transistors or PchMOS transistors. A common connection node of the switch elements 23 and 24 becomes the output node $N_{out}$ of the pixel circuit.

Both inverters 251 and 252 are, for example, CMOS inverters. Specifically, the inverter 251 is configured so that gate electrodes and drain electrodes of an NchMOS transistor $Q_{n13}$ and a PchMOS transistor $Q_{p13}$ are commonly connected, respectively. The inverter 252 is configured so that gate electrodes and drain electrodes of an NchMOS transistor $Q_{n14}$ and a PchMOS transistor $Q_{p14}$ are commonly connected, respectively.

The pixels 20, which are based on the above-described circuit configuration, are spread in the row direction (horizontal direction) and in the column direction (vertical direction) and are arranged in the form of a matrix. With respect to the matrix-shaped array of the pixels 20, in addition to the signal line 31 for each pixel column and the control line 32 for each pixel row, wirings 33 and 34 for transferring the voltage FRP having the same phase and the voltage XFRP having a reverse phase and power lines 35 and 36 for a positive power supply voltage $V_{DD}$ and a negative power supply voltage $V_{SS}$ are wired for each pixel column.

As described above, the display device (that is, active matrix type liquid crystal display device) 10 according to the application example is configured so that SRAM function pixels (MIP) 20 having latch units 25 that hold the potential according to the display data are arranged in the form of a matrix. Further, in this application example, it is exemplified that an SRAM is used as a memory unit built in the pixel 20. However, the SRAM is merely exemplary, and the memory unit may have other configurations, and for example, a configuration using a DRAM.

Since the MIP type liquid crystal display device 10 has a memory function (memory unit) for each pixel 20, as described above, it can realize the display in the analog display mode and the display in the memory display mode. Further, in the case of the memory display mode, since the display is performed using the pixel data that is maintained in the memory unit, it is not necessary to perform the write operation of the signal potential that reflects the gradation in a regular frame period in order to once perform the write operation, and thus the power consumption of the liquid crystal display device 10 can be reduced.

Further, there is a demand for partial renewal of the display screen, that is, for renewal of only a part of the display screen.

In this case, the pixel data may be partially renewed. The display screen may be partially renewed. If the pixel data is partially renewed, it is not necessary to transmit data with respect to the pixels that have not been renewed. Accordingly, the quantity of data transmission can be reduced, and thus further electric power saving of the liquid crystal display device 10 can be sought.

2-3. Area Gradation Method

In the case of the display device having the memory function in the pixel, for example, the MIP type liquid crystal display device, only two gradations can be expressed by one bit for each pixel 20. Accordingly, in the liquid crystal display device 10 according to the application example, it is preferable to use the area gradation method in adopting the MIP method.

Specifically, the area gradation method is used which divides the pixel electrode that becomes the display area of the pixel 20 into a plurality of pixel (sub-pixel) electrodes to which the heaviness is areally applied. The pixel electrode may be a transparent electrode or a reflective electrode. Further, by sending the pixel potential selected by the holding potential of the latch unit 25 to the pixel electrode to which the heaviness is areally applied, the gradation display is performed by a combination of areas to which the heaviness is applied.

Here, for easy understanding, the area gradation method that expresses four gradations by two bits by applying the heaviness of 2:1 to the area (pixel area) of the pixel electrode (sub-pixel electrode) will be described in detail as an example.

Figure 5C:
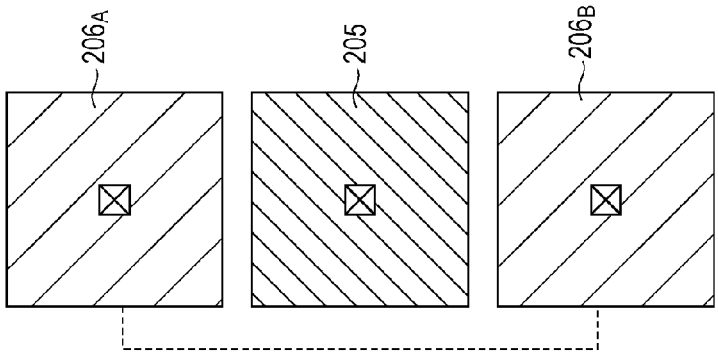
FIGS. 5A to 5C are explanatory diagrams of pixel division in an area gradation method.
Figure 5B:
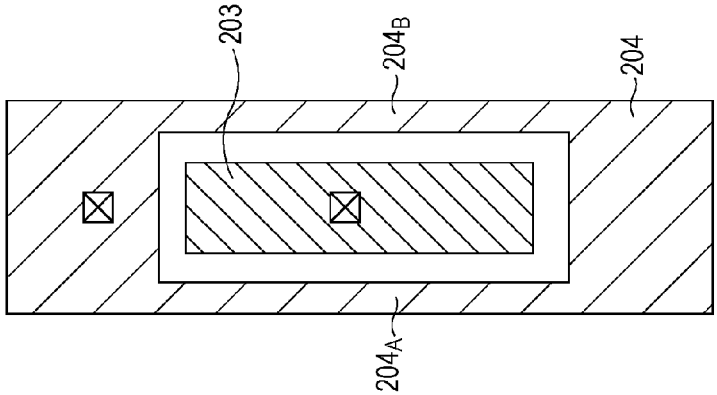
Figure 5A:
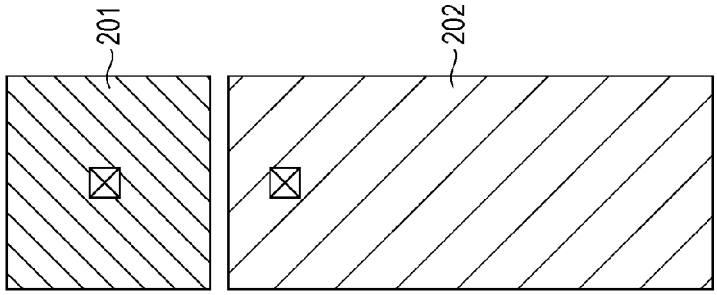

As a structure that applies the heaviness of 2:1 to the pixel area, as shown in FIG. 5A, a structure that divides the pixel electrode of the pixel 20 into a sub-pixel electrode 201 having an area 1 and a sub-pixel electrode 202 having an area (area 2) that is twice as large as the sub-pixel electrode 201 is common. However, in the case of the structure as shown in FIG. 5A, the center (the center of gravity) of each gradation (display image) does not match (does not coincide with) the center (the center of gravity) of one pixel, and thus it is unfavorable on the point of gradation expression.

As the structure that matches the center of each gradation with the center of one pixel, as shown in FIG. 5B, a structure in which the center portion of the sub-pixel electrode 204 of the area 2 is dug out, for example, by a rectangular shape, and a sub-pixel electrode 203 of the area 1 is arranged in the dug center portion of the rectangular area may be considered. However, in the case of the structure of FIG. 5B, since the widths of connection portions $\mathbf{204}_A$ and $\mathbf{204}_B$ of the sub-pixel electrode 204, which are positioned on both sides of the sub-pixel electrode 203, are narrow, the reflective area of the whole of the sub-pixel electrode 204 becomes smaller, and liquid crystal alignment in the vicinity of the connection portions $\mathbf{204}_A$ and $\mathbf{204}_B$ becomes difficult.

As described above, if liquid crystal molecules intend to be in a VA (Vertically Aligned) mode in which liquid crystal molecules are almost perpendicular to the substrate in no electric field at area gradation, the side of the liquid crystal molecules to which the voltage is applied is changed due to the electrode shape or electrode size, it is difficult to perform liquid crystal alignment well. Further, since the area ratio of the sub-pixel electrode may not necessarily be the reflection ratio, the gradation design becomes difficult. The reflection ratio is determined by the area of the sub-pixel electrode or the liquid crystal alignment. In the case of the structure of FIG. 5A, even though the area ratio is 1:2, the ratio of the length around the electrode does not become 1:2. Accordingly, the area ratio of the sub-pixel electrode may not necessarily be the reflection ratio.

From this viewpoint, in adopting the area gradation method, in consideration of the expression characteristics of the gradation and the effective utilization of the reflective area, as shown in FIG. 5C, it is preferable that the pixel electrode is divided into, for example, three sub-pixel electrodes 205, $\mathbf{206}_A$, and $\mathbf{206}_B$ having the same area (size), so-called three-division electrode construction.

In the case of the three-division electrode construction, assuming the two upper and lower sub-pixel electrodes $\mathbf{206}_A$ and $\mathbf{206}_B$, between which the center sub-pixel electrode 205 is inserted, as a group, the two sub-pixel electrodes $\mathbf{206}_A$ and $\mathbf{206}_B$, which constitute the group, are simultaneously driven. At this time, the lower bit is connected to the sub-pixel electrode 205 of the area 1, and the higher bit is connected to the sub-pixel electrodes $\mathbf{206}_A$ and $\mathbf{206}_B$ of the area 2. Through this, the heaviness of 2:1 can be applied to the pixel area between the two sub-pixel electrodes $\mathbf{206}_A$ and $\mathbf{206}_B$ and the center sub-pixel electrode 205. Further, by dividing the sub-pixel electrodes $\mathbf{206}_A$ and $\mathbf{206}_B$ of the area 2 of the higher bits into two and insert the center sub-pixel electrode 205 between the divided sub-pixel electrodes $\mathbf{206}_A$ and $\mathbf{206}_B$ so that the divided sub-pixel electrodes $\mathbf{206}_A$ and $\mathbf{206}_B$ are arranged up and down, the center (the center of gravity) of each gradation may match the center (the center of gravity) of one pixel.

Here, if the three sub-pixel electrodes 205, $\mathbf{206}_A$, and $\mathbf{206}_B$ are in electrical contact with the driving circuits, the number of contacts of the metal wiring is increased in comparison to the structures of FIGS. 5A and 5B, and the pixel size is increased to hinder the high accuracy. In particular, in the case of the MIP type pixel configuration having a memory unit for each pixel 20, as is clear from FIG. 4, many circuit constituent elements such as transistors and contact portions exist in one pixel 20, and the layout area is not sufficient to cause the one contact portion to greatly affect the pixel size.

Figure 6:
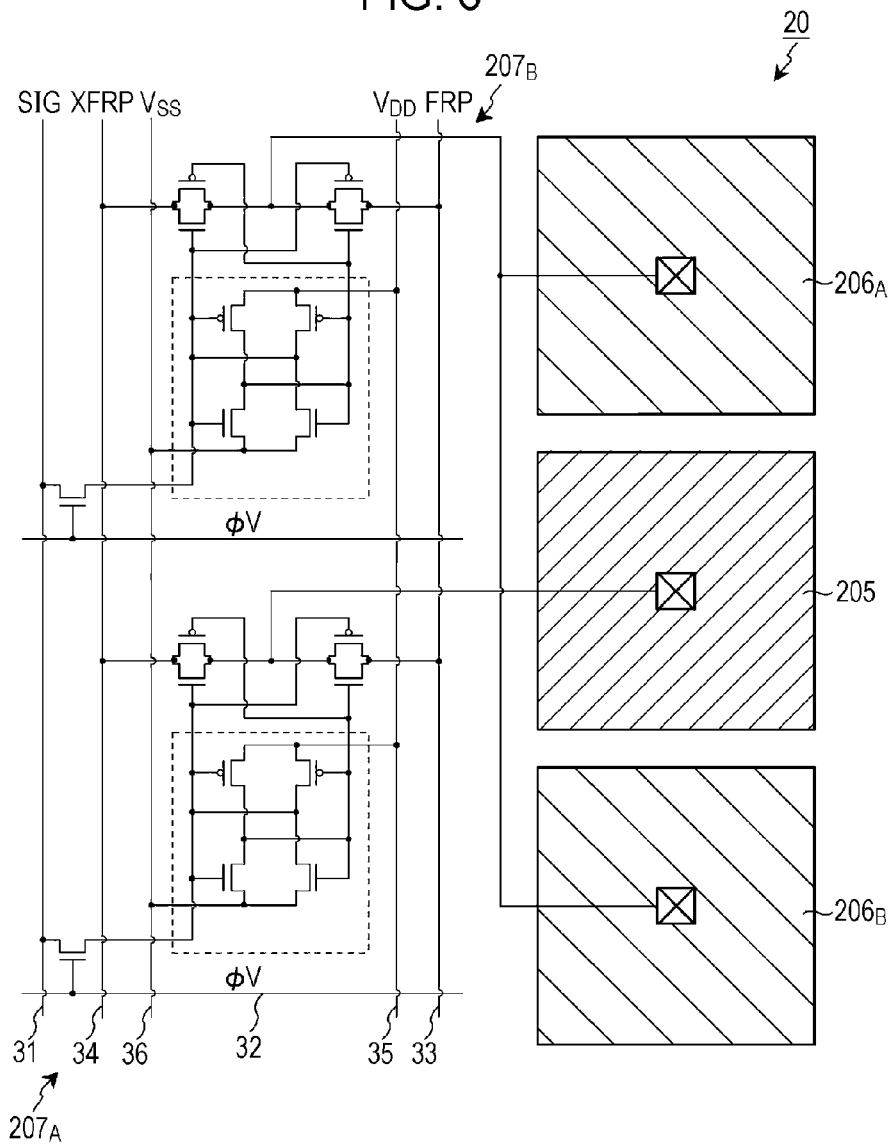
FIG. 6 is a circuit diagram illustrating correspondence relations between three sub-pixel electrodes and two sets of driving circuits in a three-division pixel structure.

In order to reduce the number of contacts, the pixel structure may be adopted in which the two sub-pixel electrodes $\mathbf{206}_A$ and $\mathbf{206}_B$, which are further spaced apart from each other due to the insertion of one sub-pixel electrode 205 between them, are electrically coupled (wired) to each other. Further, as shown in FIG. 6, the one sub-pixel electrode 205 is driven by the one driving circuit $\mathbf{207}_A$, and the two remaining sub-pixel electrodes $\mathbf{206}_A$ and $\mathbf{206}_B$ are simultaneously driven by the other driving circuit $\mathbf{207}_B$. Here, the driving circuits $\mathbf{207}_A$ and $\mathbf{207}_B$ correspond to the pixel circuit illustrated in FIG. 4.

As described above, by driving the two sub-pixel electrodes $\mathbf{206}_A$ and $\mathbf{206}_B$ through the one driving circuit $\mathbf{207}_B$, the circuit configuration of the pixel 20 can be simplified in comparison to the case where the two sub-pixel electrodes $\mathbf{206}_A$ and $\mathbf{206}_B$ are driven by separate driving circuits.

Here, it is exemplified that the MIP type pixel having a memory unit that can store data for each pixel is used as the pixel having the memory function. However, this is merely exemplary. In addition to the MIP type pixel, the pixel having the memory function may be, for example, a pixel using existing memory-related liquid crystals.

2-4. Area Gradation+FRC Driving

However, according to the MIP technology, since the number of memories for one pixel that can be integrated from the limitation of the design rule is restricted, the number of expression colors is also restricted. For example, in the case of the display device of 180 PPI (corresponding to 7-inch XGA), the limitation of the number of integrations of the memory is two bits for each color of RGB, and in a normal driving using the area gradation, the limitation of the number of integrations of the memory is four gradations for each color, so that the number of expression colors becomes 64 in total. Through this, by introducing the FRC driving and performing driving of area gradation+FRC driving, the number of expression gradations can be increased.

Two-Bit Area Gradation+One-Bit FRC Driving

Figure 7B:
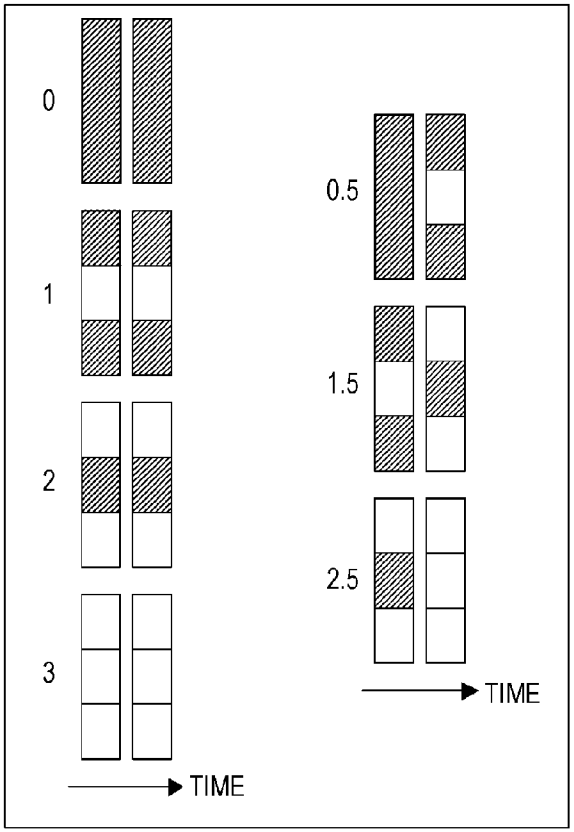
FIGS. 7A and 7B are explanatory diagrams in the case of a two-bit area gradation and in the case of two-bit area gradation+one-bit FRC driving.
Figure 7A:
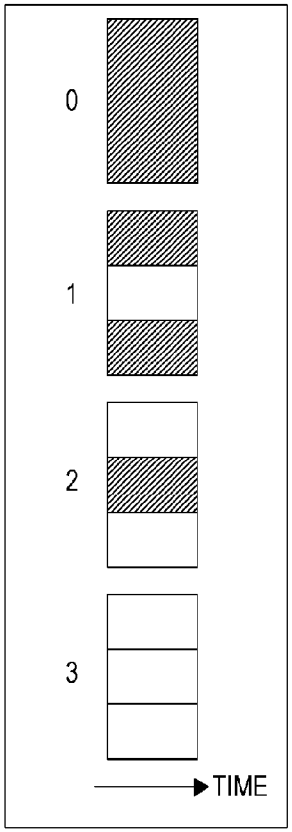

Here, a case where one-bit FRC driving is performed with respect to two-bit area gradation (area ratio=1:2) will be described using FIGS. 7A and 7B. In the case of two-bit area gradation+one-bit FRC driving, 7-gradation display is performed.

First, the case of only two-bit area gradation will be described using FIG. 7A. In the case of the two-bit area gradation only, one screen is constituted in the period of one frame. As shown in FIG. 7A, four-gradation display is performed in total, in which a state where three sub-pixels are all in a lights-out state is represented by 0, a state where only the center sub-pixel is in a lighting state is represented by 1, a state where two upper and lower sub-pixels are in a light state is represented by 2, and a state where three sub-pixels are all in a lighting state is represented by 3.

By contrast, in the case of the two-bit area gradation+one-bit FRC driving, one screen is constituted in the period of two frames (subframes). Further, the same lighting drive is performed with two frames, and three gradations of 0.5, 1.5, and 2.5 as illustrated in FIG. 7B are added to the above-described four gradations.

In the case of gradation of 0.5, three sub-pixels are all in a lights-out state in the first frame, and only the center sub-pixel is in a lighting state in the second frame. In the case of gradation of 1.5, only the center sub-pixel is in a lighting state in the first frame, and two upper and lower sub-pixels are in a lighting state in the second frame. In the case of gradation of 2.5, the two upper and lower sub-pixels are in a lighting state in the first frame, and the three sub-pixels are all in a lighting state in the second frame.

As is clear from the above description, by using the FRC driving that is the driving method for displaying a middle gradation luminance of a plurality of gradation luminance together, the number of display gradations can be increased as large as the FRC driving bits. In this connection, if three-bit pixel configuration is simply assumed, the corresponding circuits are packed into the pixel (sub-pixel) 20, and thus unless the wiring rule is made with high accuracy, the pixel size becomes large and it becomes disadvantageous to seek the high accuracy of the display device.

Further, according to the area gradation in the pixel structure in which the pixel 20 has the three-division electrode configuration, and two upper and lower sub-pixel electrodes $\mathbf{206}_A$ and $\mathbf{206}_B$, between which the sub-pixel electrode 205 is inserted, are simultaneously driven, the center of the pixel of the gradation display and the center of the display image (gradation) between the plurality of frames can coincide with each other. Here, the "coincidence" includes a case where the center of the pixel of the gradation display and the center of the display image (gradation) between the plurality of frames substantially coincide with each other in addition to the case where the centers strictly coincide with each other. The existence of non-uniformity that occurs in a design or production is permitted.

Further, since the fluctuation in the frame period does not occur to the displayed image through coincidence of the center of the pixel with the center of the gradation (display image) between frames (subframes), the display characteristics can be improved. Further, since the fluctuation in the frame period does not occur in the displayed image, it is possible to slow the time (frame rate) of the frame period, and thus the power consumption under the FRC driving can be reduced.

Two-Bit Area Gradation+Two-Bit FRC Driving

Next, a case where two-bit FRC driving is performed with respect to two-bit area gradation (area ratio=1:2) will be described using FIG. 8.

Figure 8:
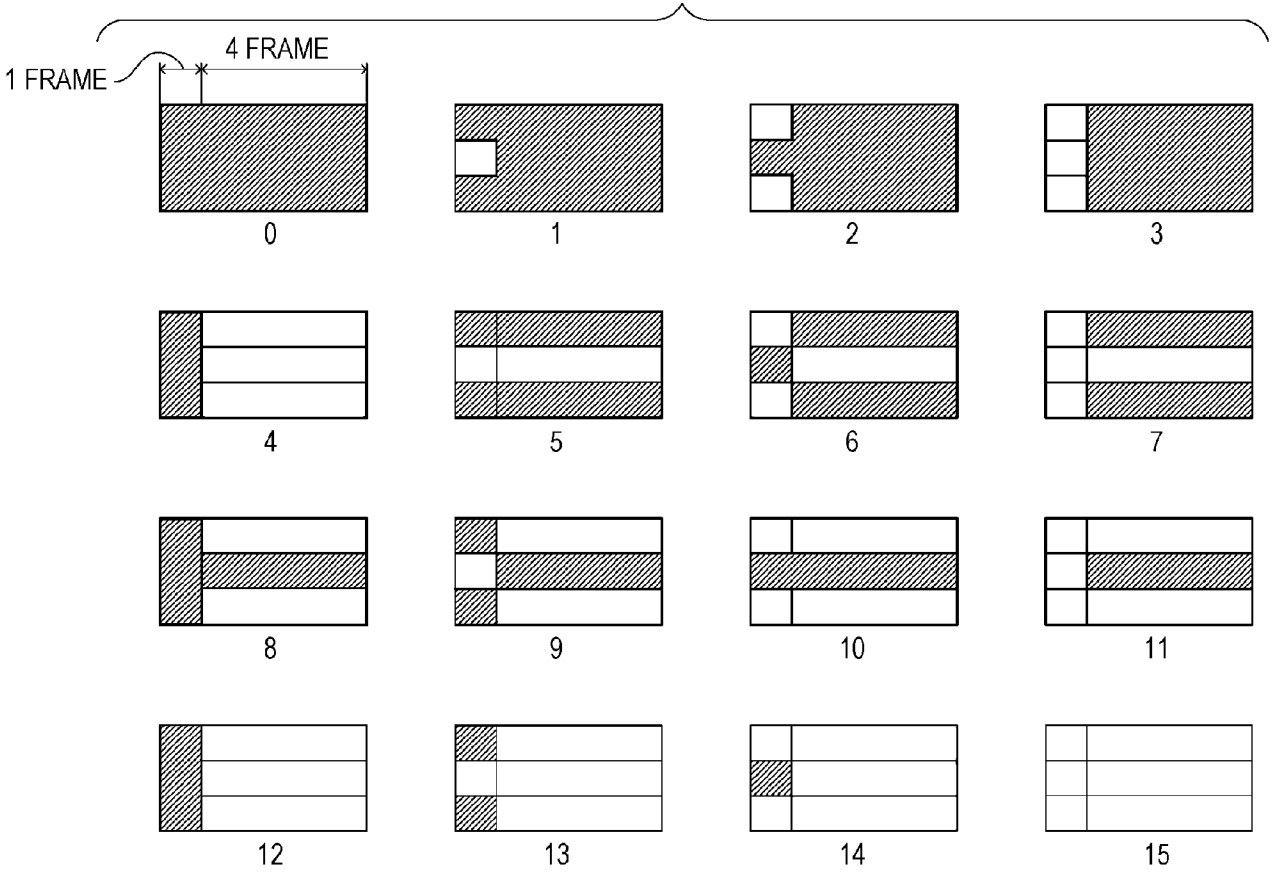
FIG. 8 is an explanatory diagram in the case of two-bit area gradation+two-bit FRC driving.

As shown in FIG. 8, in the case of two-bit area gradation+two-bit FRC driving, the gradation expression for four bits (=16 gradation) corresponding to two bits in space and two bits in time can be realized by dividing time for expressing one gradation (time to be used for gradation expression) into 1:4. Here, division of the time for expressing one gradation into 1:4 means expression of one gradation with five frames (subframes).

As described above, in the case of two-bit area gradation+two-bit FRC driving, five frames are necessary for the gradation expression, and thus one gradation is expressed as one frame. That is, 5-speed driving is necessary with respect to the normal driving that assumes one frame as one period. 5-speed driving means to renew the contents of the memory unit of the pixel 20 by 5-speed driving.

In the FRC driving in which high-speed driving is necessary, a situation that the operating speed of the driving unit is unable to support such a high speed may occur. If the overall driving frequency is lowered to prevent the occurrence of such a situation, screen flickering becomes easily visually recognizable in the change timing of bits of gradation data. Here, although the case of two-bit area gradation+two-bit FRC driving is exemplified to explain the problem, about the problem concerned, it is able to say equally even in the case of the FRC driving alone.

3. Explanation of Embodiments

In this embodiment, the following configuration is adopted to solve the problem of the high operating speed in the case of applying the FRC driving for the purpose of raising the number of gradations. That is, in performing the display driving through the FRC driving, writing of the lower bits and the higher bits of the gradation data are discontinuously performed with respect to the pixels 20 in the scanning direction in the unit of one line or a plurality of lines. Such driving is performed under the driving of the driving unit of the liquid crystal display device 10, that is, the signal line driving unit 40, the control lined driving unit 50, and the drive timing generation unit 60.

As described above, by discontinuously writing the lower bits and the higher bits of the gradation data with respect to the pixels 20 in the scanning direction, the change timing of the bits of the gradation data is dispersed, and thus the screen flickering in the change timing of the bits of the gradation data can be reduced. Accordingly, the FRC driving can be realized while reducing the screen flickering in the change timing of the bits of the gradation data.

Hereinafter, detailed examples for performing the above-described driving will be described.

3-1. Reference Example 1

Figure 9:
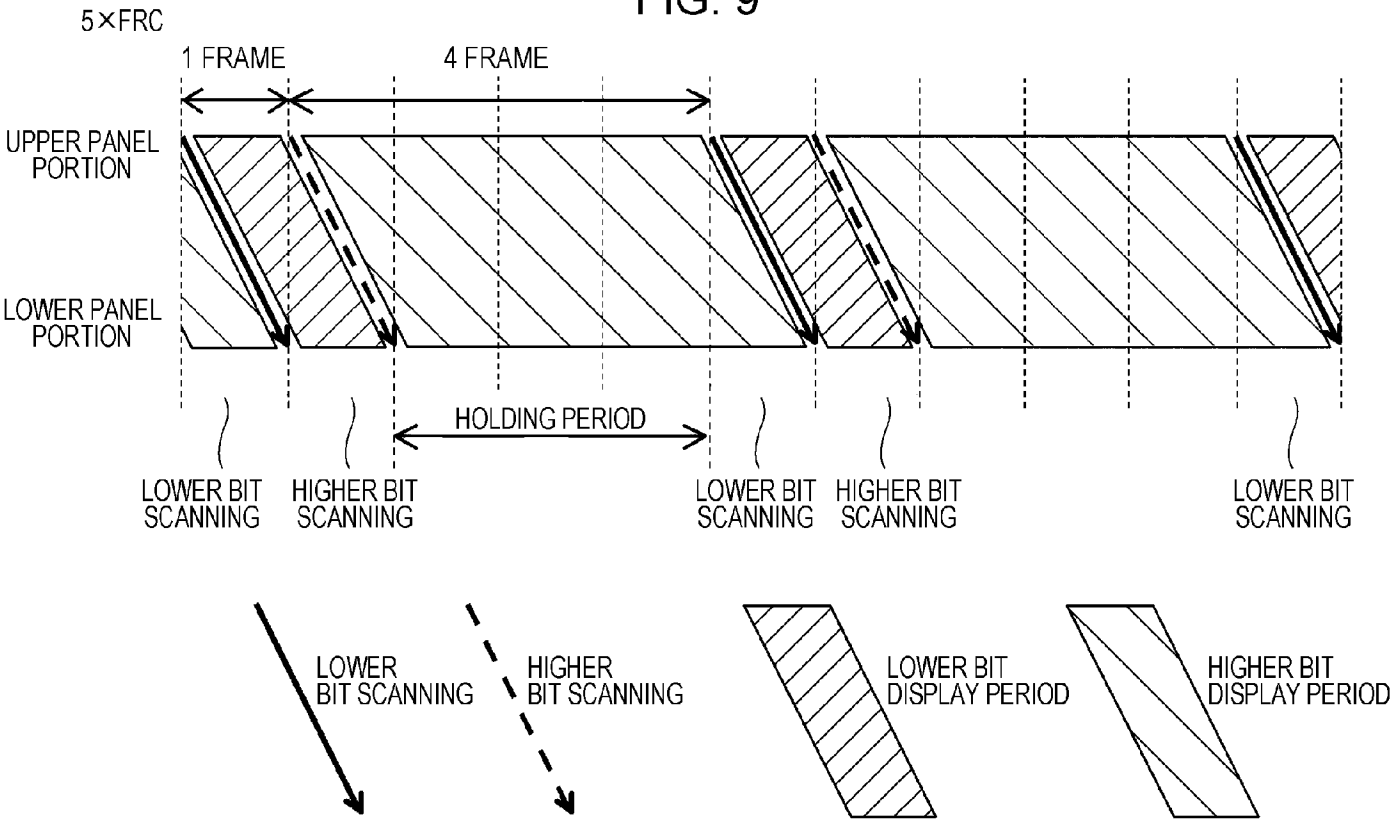
FIG. 9 is a timing chart provided to explain the operation of a driving method to affect a reference example 1 in the case of two-bit area gradation+two-bit FRC driving.

Before describing the embodiments, the related art driving method in the case of two-bit area gradation+two-bit FRC driving for which 5-speed driving is necessary will be described using a timing chart of FIG. 9 as the driving method according to the reference example 1.

As described above, in the case of two-bit area gradation+two-bit FRC driving, five frames (that is, one frame+four frames) in total are necessary for the gradation expression. Further, in writing the gradation data onto the pixel 20, as shown in FIG. 9, with respect to the lower bit at an initial first frame, continuous scanning is performed with respect to the entire lines from an upper portion of the liquid crystal display panel 11 (hereinafter simply described as "upper panel portion") to a lower portion of the liquid crystal display panel 11 (hereinafter simply described as "lower panel portion").

Next, with respect to the higher bit in the second frame, scanning is performed from the upper panel portion to the lower panel portion. Then, if the period of three frames passes, that is, if one period that assumes five frames as a unit passes, the above-described operation, that is, continuous writing of data with respect to the entire lines from the upper panel portion to the lower panel portion in the unit of a frame in the order of the lower bit and the higher bit is repeated. Then, this series of operations is performed under the 5-speed driving.

As described above, in the case of the driving method according to reference example 1, after continuous writing of the data of the lower bit with respect to the entire lines from the upper panel portion to the lower panel portion, continuous wiring of the data of the higher bit in the next frame is performed with respect to the entire lines from the upper panel portion to the lower panel portion. Accordingly, the period of three frames until the writing of the next lower bit is performed after writing of the higher bit is finished becomes a holding period. This holding period is a period in which no operation is performed, and thus is useless on the driving.

3-2. Example 1

Figure 10:
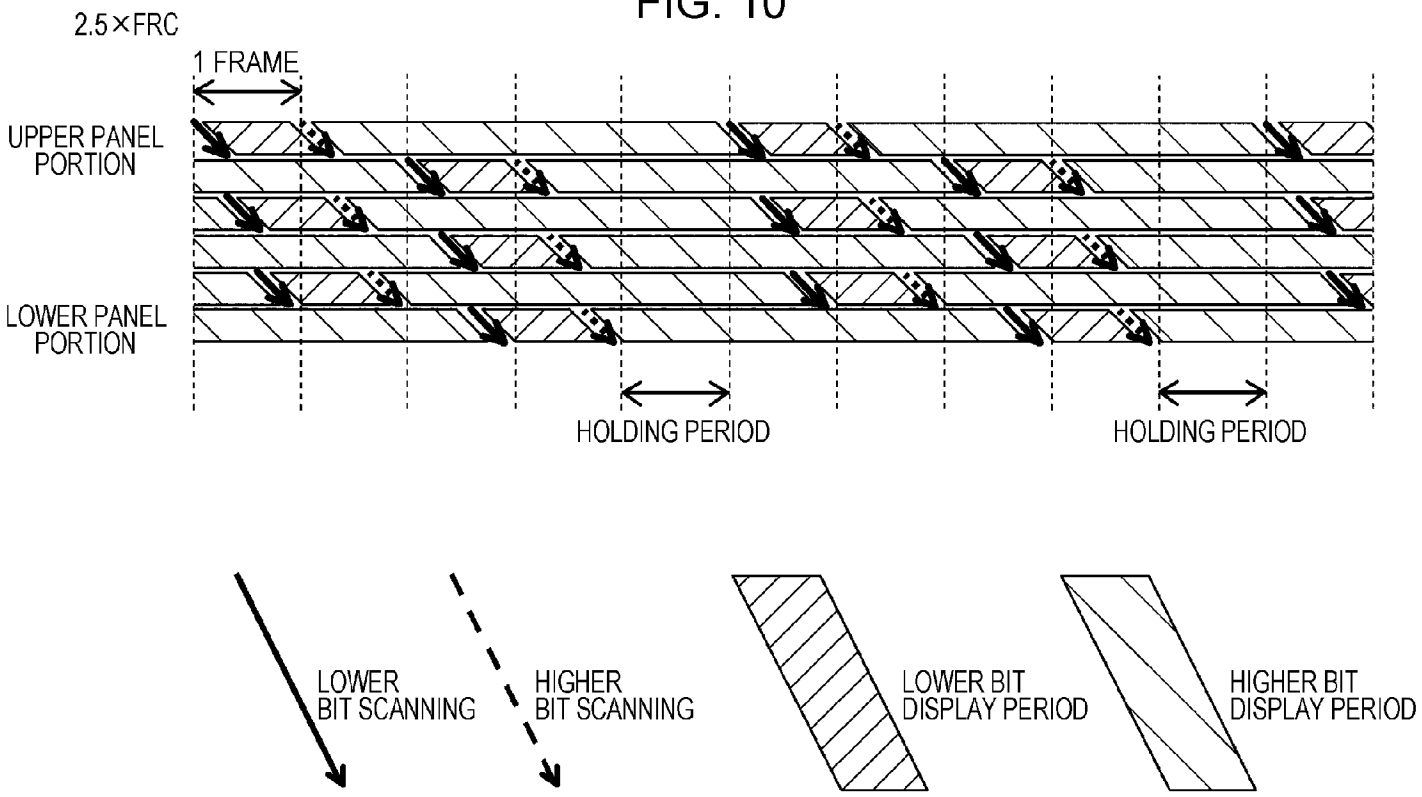
FIG. 10 is a timing chart provided to explain the operation of a driving method to affect an example 1 in the case of two-bit area gradation+two-bit FRC driving.

FIG. 10 is a timing chart provided to explain the operation of a driving method to affect an example 1 in the case of two-bit area gradation+two-bit FRC driving.

In the driving method according to example 1, when the display driving is performed by the FRC driving, the scanning is performed in the unit of one line or a plurality of lines. Accordingly, in FIG. 10, one horizontal line corresponds to one block in the unit of one line or a plurality of lines.

Hereinafter, for easy understanding, a case where the scanning is performed in the unit of one line is exemplified. In FIG. 10, for simplification of the drawing, six lines are illustrated. The first line is a line of the highest panel line and the sixth line is a line of the lowest panel line.

In the driving method according to example 1, before writing of one side of data of the lower bits and the higher bits of the gradation data is finished with respect to the entire lines, insertion of writing of other data of the lower bits and the higher bits is performed.

Specifically, writing of the one side of data of the lower bits and the higher bits is performed by interlaced scanning in the unit of one line (or a plurality of lines) and then writing of other data of the lower bits and the higher bits is performed by interlaced scanning with respect to the same lines as the one side of data. Next, writing of the one side of data and other data is sequentially performed by interlaced scanning with respect to the interlaced lines.

This will be described in more detail using FIG. 10. First, writing of the data of the lower bits is performed by interlaced scanning with respect to odd lines, that is, the first line, the third line, and the fifth line, and then writing of the data of the higher bits is performed by interlaced scanning with respect to the same odd lines as the data of the lower bits.

Then, writing of the data of the lower bits is performed by interlaced scanning with respect to interlaced even lines during an initial writing, that is, the second line, the fourth line, and the sixth line, and then writing of the data of the higher bits is performed by interlaced scanning with respect to the same even lines as the data of the lower bits.

The write driving by the above-described series of interlaced scanning becomes so-called interlaced driving. By the interlaced driving, as can be seen from comparison of FIG. 9 with FIG. 10, write driving using most of the holding period of three frames in FIG. 9 can be performed, and this holding period can be shortened to a period of one frame.

Further, since the writing is performed by interlaced scanning, time that is necessary to write each frame becomes ½ of the case where continuous writing is performed with respect to the entire lines in one-frame period. Accordingly, in the case of two-bit area gradation+two-bit FRC driving, the driving frequency can be reduced from 5 times to 2.5 times.

As described above, by inserting writing of other data of the lower bits and the higher bits before finishing writing of the one side of data of the lower bits and the higher bits of the gradation data with respect to the entire lines, 2.5-speed FRC driving can be realized. Further, even if the driving frequency is lowered from 5 times to 2.5 times, the change timing of the bits of the gradation data is dispersed by the interlaced driving, and thus the screen flickering in the change timing of the bits of the gradation data can be reduced. Accordingly, it is possible to realize the FRC driving while reducing the screen flickering in the change timing of the bits of the gradation data.

3-3. Reference Example 2

Figure 11:
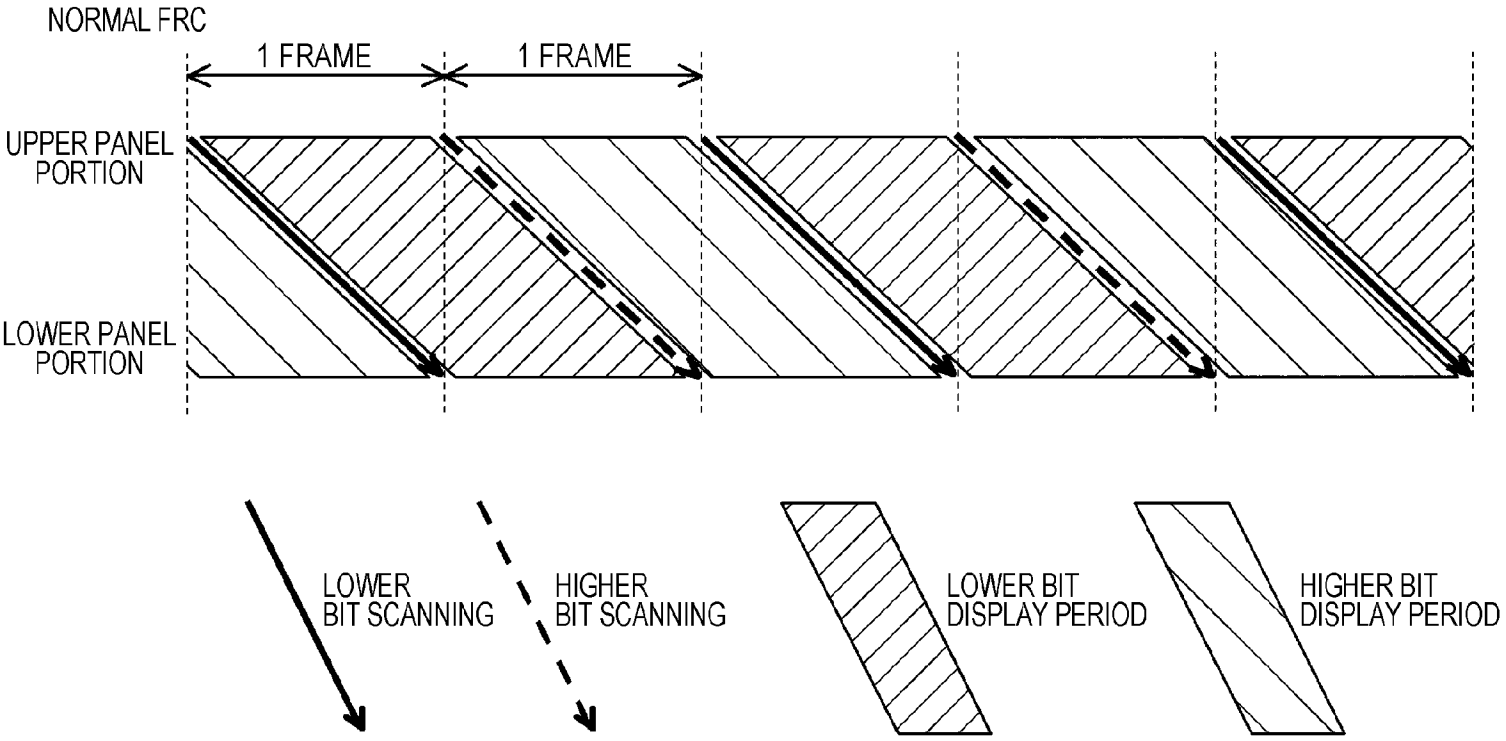
FIG. 11 is a timing chart provided to explain the operation of a driving method to affect a reference example 2 in the case of two-bit area gradation+two-bit FRC driving.

Next, the driving method in the case of two-bit area gradation+one-bit FRC driving will be described as the driving method according to example 2. Before this, the driving method in the related art will be described using FIG. 11 as reference example 2.

In the case of two-bit area gradation+one-bit FRC driving, in two frames (that is, one frame+one frame) in total for the gradation expression, continuous scanning and writing of the data of the lower bits and the higher bits are performed, alternately for each frame, from the upper panel portion to the lower panel portion. Accordingly, the change timing of the bits of the gradation data matches one-frame period. Due to this, the screen flickering in the change timing of the bits of the gradation data becomes easy to be outstanding.

3-4. Example 2

Figure 12:
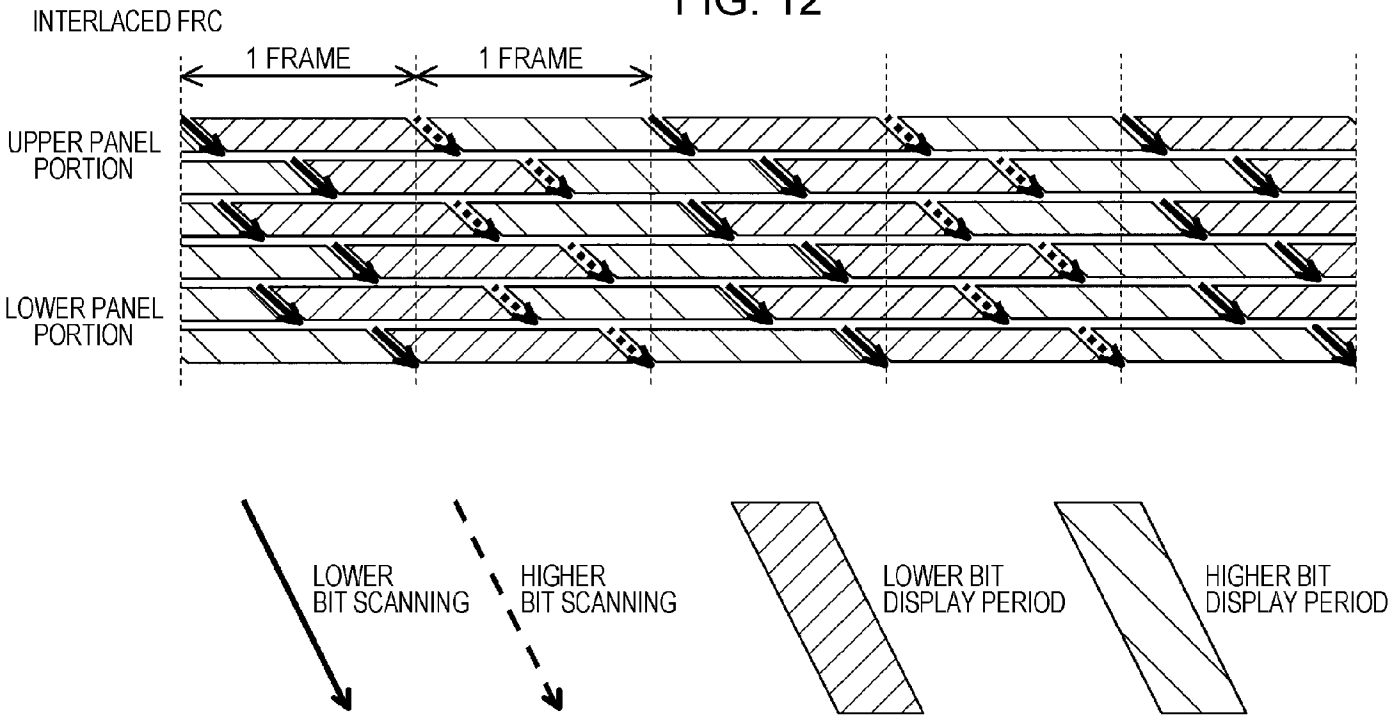
FIG. 12 is a timing chart provided to explain the operation of a driving method to affect an example 2 in the case of two-bit area gradation+one-bit FRC driving.

FIG. 12 is a timing chart provided to explain the operation of a driving method to affect an example 2 in the case of two-bit area gradation+one-bit FRC driving.

Even in the driving method according to example 2, when the display driving is performed by the FRC driving, the scanning is performed in the unit of one line or a plurality of lines. Accordingly, in FIG. 12, one horizontal line corresponds to one block in the unit of one line or a plurality of lines.

Hereinafter, for easy understanding, a case where the scanning is performed in the unit of one line is exemplified. In FIG. 12, for simplification of the drawing, six lines are illustrated. The first line is a line of the highest panel line and the sixth line is a line of the lowest panel line.

In the driving method according to example 2, discontinuous writing is performed with respect to one side of data of the lower bits and the higher bits of the gradation data in a certain frame in the scanning direction, and then discontinuous writing of other data of the lower bits and the higher bits in the next frame is performed in the scanning direction.

Specifically, as shown in FIG. 12, writing of the data of the lower bits in a certain frame is performed by interlaced scanning with respect to odd lines, that is, the first line, the third line, and the fifth line. Then, writing of the same data of the lower bits is performed by interlaced scanning with respect to the interlaced even lines during an initial writing, that is, the second line, the fourth line, and the sixth line.

In the next frame, writing of the data of the higher bits is performed by interlaced scanning with respect to odd lines, that is, the first line, the third line, and the fifth line. Then, writing of the same data of the higher bits is performed by interlaced scanning with respect to the interlaced even lines during the initial writing, that is, the second line, the fourth line, and the sixth line. The above-described series of write driving is repeated.

As described above, by performing discontinuous writing of the one side of data of the lower bits and the higher bits in a certain frame in the scanning direction and performing discontinuous writing of other data in the next frame in the scanning direction, the change timing of the bits of the gradation data is dispersed. Through this, the screen flickering in the change timing of the bits of the gradation data can be reduced.

Further, in the example 2, since one line is assumed as the unit, the interlaced scanning is performed as an odd line and an even line. However, if a plurality of lines are assumed as the unit, the interlaced scanning is performed as an odd line group (odd block) and an even line group (even block).

As described above, in example 1 and example 2, both the area gradation and the FRC driving are used. However, the driving method according to the present disclosure is not limited thereto, but can be applied to a case of the FRC driving alone. Hereinafter, the driving method that is applicable to the FRC driving alone will be described as the driving method according to example 3 and example 4.

3-5. Example 3

Figure 13:
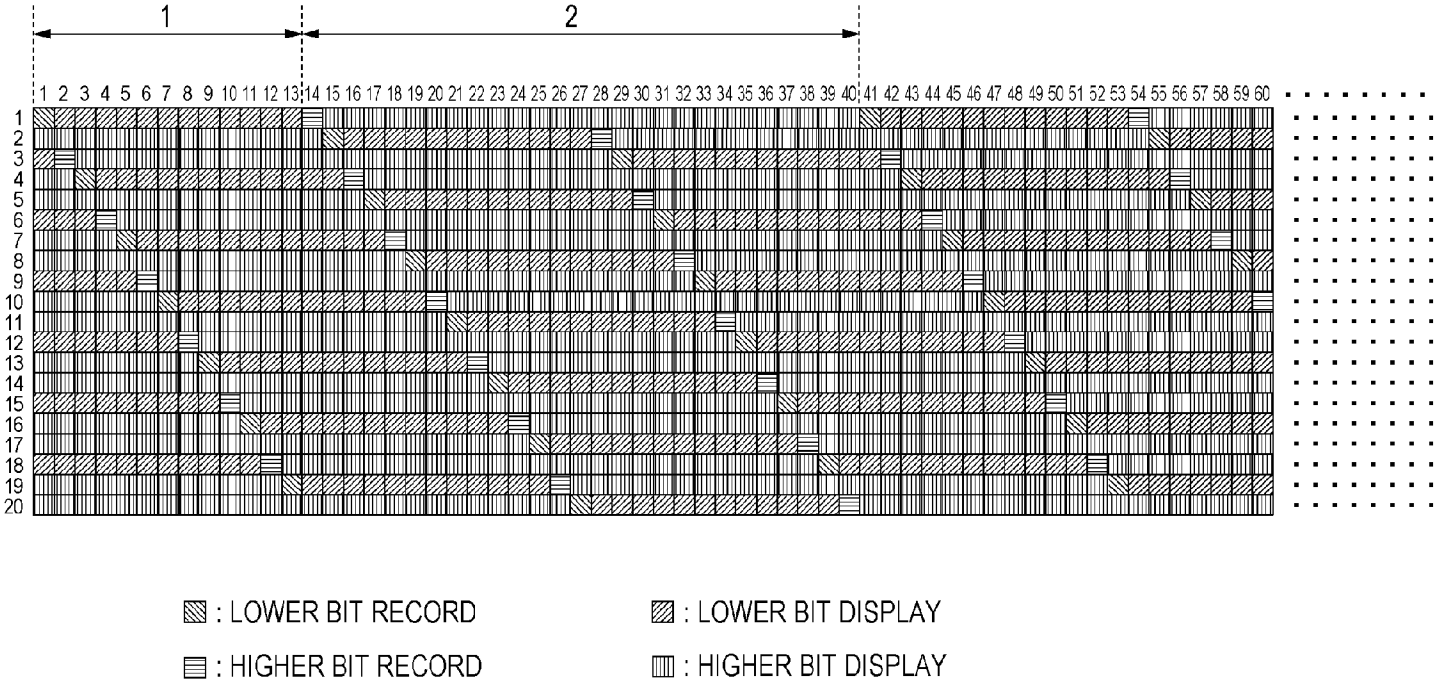
FIG. 13 is a timing chart provided to explain the operation of a driving method to affect an example 3 in the case of FRC driving of time division of 1:2.

FIG. 13 is a timing chart provided to explain the operation of a driving method to affect an example 3 in the case of FRC driving of time division of 1:2.

The driving method according to example 3 is the FRC driving of time division of 1:2. In the case of the FRC driving of time division of 1:2, as shown in FIG. 13, the first line has the time division ratio of 1:2 in which a period that corresponds to, for example, 13 pixels from the first pixel to the $13^{th}$ pixel is 1, and a period that corresponds to 27 pixels from the $14^{th}$ pixel to the $40^{th}$ pixel is 2. Here, for simplification in the drawing, it is exemplified that 20 horizontal lines are provided. It is not actually the time division ratio of 1:2, and if there are a large number of lines, it may be assumed as the range of error.

As concrete driving, as shown in FIG. 13, in the first line, the lower bit is written at the first pixel, the $41^{st}$ pixel, and the like, and the higher bit is written at the $14^{th}$ pixel, the $54^{th}$ pixel, and the like. At this time, in the first line, the period from the second pixel to the $13^{th}$ pixel becomes a display period of the lower bits, and the period from the $15^{th}$ pixel to the $40^{th}$ pixel becomes a display period of the higher bits.

In the second line, the lower bit is written at the $15^{th}$ pixel, the $55^{th}$ pixel, and the like, and the higher bit is written at the $28^{th}$ pixel, the $68^{th}$ pixel, and the like. At this time, in the second line, the period from the $16^{th}$ pixel to the $27^{th}$ pixel becomes a display period of the lower bits, and the period from the $29^{th}$ pixel to $54^{th}$ pixel becomes a display period of the higher bits.

In the third line, the higher bit is written at the second pixel, the $42^{nd}$ pixel, and the like, and the lower bit is written at the $29^{th}$ pixel, the $69^{th}$ pixel, and the like. At this time, in the third line, the period from the third pixel to the $28^{th}$ pixel becomes a display period of the higher bits, and the period from the $30^{th}$ pixel to the $41^{st}$ pixel becomes a display period of the lower bits.

In the fourth line, the lower bit is written at the third pixel, the $43^{rd}$ pixel, and the like, and the higher bit is written at the $16^{th}$ pixel, the $56^{th}$ pixel, and the like. At this time, in the fourth line, the period from the fourth pixel to the $15^{th}$ pixel becomes a display period of the lower bits, and the period from the $17^{th}$ pixel to $42^{nd}$ pixel becomes a display period of the higher bits.

Thereafter, the write driving of the lower bits and the higher bits is performed from the last line in consideration of the above-described driving from the first line to the fourth line as the basic driving.

Even in the driving method according to example 3, in the same manner as the driving method according to example 1 and example 2, the write driving of the lower bits and higher bits of the gradation data are discontinuously performed with respect to pixels in the scanning direction in the unit of one line. Through this, since the change timing of the bits of the gradation data is dispersed, the screen flickering in the change timing of the bits of the gradation data can be reduced. Further, as can be seen from FIG. 13, since the writing of the lower bits and the higher bits between lines does not overlap and the holding period does not exist, the FRC driving can be realized without waste in driving.

3-6. Example 4

Figure 14:
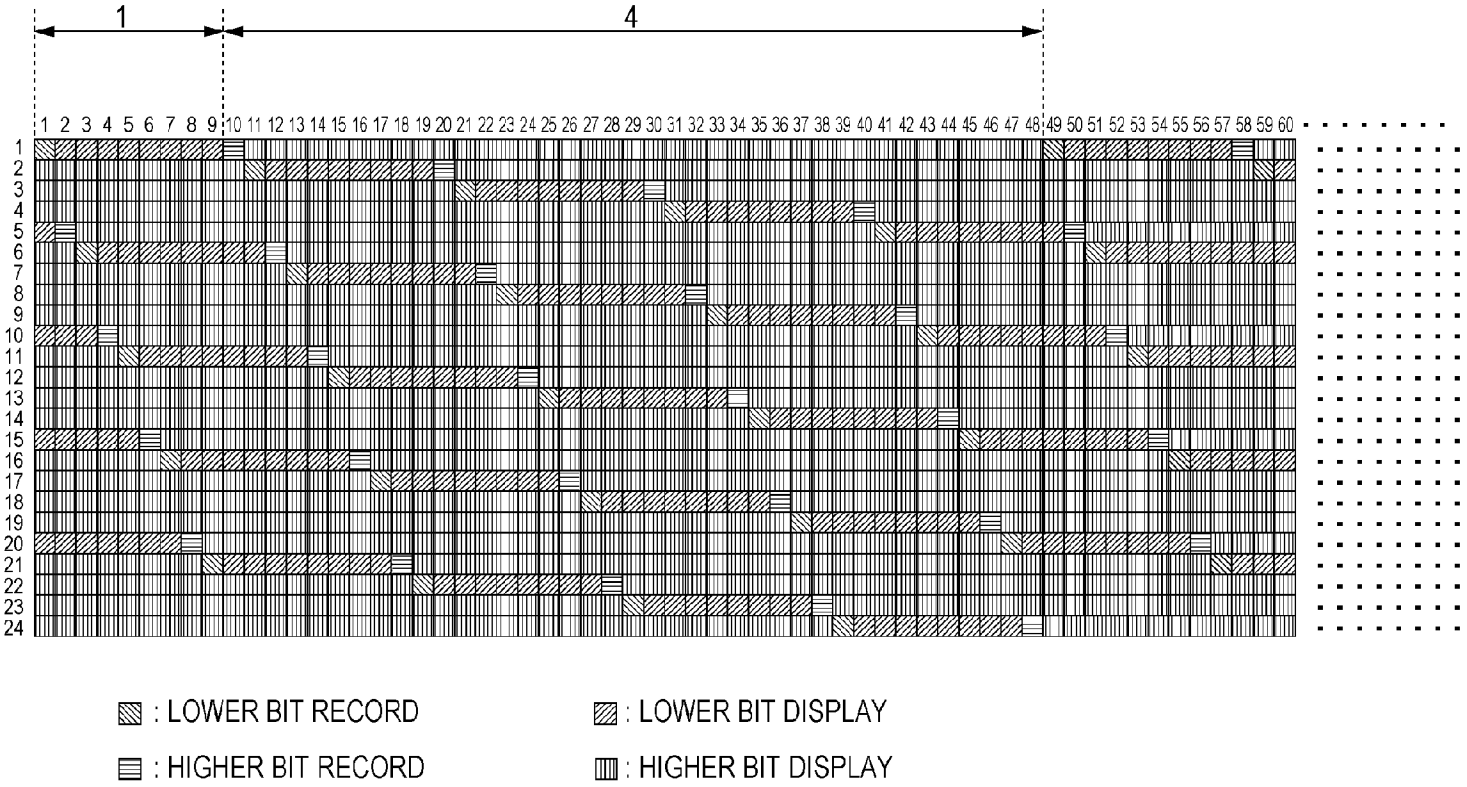
FIG. 14 is a timing chart provided to explain the operation of a driving method to affect an example 3 in the case of FRC driving of time division of 1:4.

FIG. 14 is a timing chart provided to explain the operation of a driving method to affect an example 4 in the case of FRC driving of time division of 1:4.

The driving method according to example 4 is the FRC driving of time division of 1:4. In the case of the FRC driving of time division of 1:4, as shown in FIG. 14, the first line has the time division ratio of 1:4 in which a period that corresponds to, for example, 9 pixels from the first pixel to the $9^{th}$ pixel is 1, and a period that corresponds to 39 pixels from the $10^{th}$ pixel to the $48^{th}$ pixel is 4. Here, for simplification in the drawing, it is exemplified that 24 horizontal lines are provided. It is not actually the time division ratio of 1:4, and if there are a large number of lines, it may be assumed as the range of error.

As concrete driving, as shown in FIG. 14, in the first line, the lower bit is written at the first pixel, the $49^{th}$ pixel, and the like, and the higher bit is written at the $10^{th}$ pixel, the $58^{th}$ pixel, and the like. At this time, in the first line, the period from the second pixel to the $9^{th}$ pixel becomes a display period of the lower bits, and the period from the $11^{th}$ pixel to the $48^{th}$ pixel becomes a display period of the higher bits.

In the second line, the lower bit is written at the $11^{th}$ pixel, the $59^{th}$ pixel, and the like, and the higher bit is written at the $20^{th}$ pixel, the $68^{th}$ pixel, and the like. At this time, in the second line, the period from the $12^{th}$ pixel to the $19^{th}$ pixel becomes a display period of the lower bits, and the period from the $21^{st}$ pixel to $58^{th}$ pixel becomes a display period of the higher bits.

In the third line, the lower bit is written at the $21^{st}$ pixel, and the like, and the higher bit is written at the $30^{th}$ pixel, and the like. At this time, in the third line, the period from the $22^{nd}$ pixel to the $29^{th}$ pixel becomes a display period of the lower bits, and the period from the $31^{st}$ pixel to the $68^{th}$ pixel becomes a display period of the higher bits.

In the fourth line, the lower bit is written at the $31^{st}$ pixel, and the like, and the higher bit is written at the $40^{th}$ pixel, and the like. At this time, in the fourth line, the period from the $32^{nd}$ pixel to the $39^{th}$ pixel becomes a display period of the lower bits, and the period from the $41^{st}$ pixel to the $78^{th}$ pixel becomes a display period of the higher bits.

In the fifth line, the higher bit is written at the second pixel, the $50^{th}$ pixel, and the like, and the lower bit is written at the $41^{st}$ pixel, the $89^{th}$ pixel, and the like. At this time, in the fifth line, the period from the third pixel to the $40^{th}$ pixel becomes a display period of the higher bits, and the period from the $42^{nd}$ pixel to the $49^{th}$ pixel becomes a display period of the lower bits.

Thereafter, the write driving of the lower bits and the higher bits is performed from the last line in consideration of the above-described driving from the first line to the fifth line as the basic driving.

Even in the driving method according to example 4, in the same manner as the driving method according to example 1 and example 2, the write driving of the lower bits and higher bits of the gradation data are discontinuously performed with respect to pixels in the scanning direction in the unit of one line. Through this, since the change timing of the bits of the gradation data is dispersed, the screen flickering in the change timing of the bits of the gradation data can be reduced. Further, as can be seen from FIG. 13, since the writing of the lower bits and the higher bits between lines does not overlap and the holding period does not exist, the FRC driving can be realized without waste in driving.

4. Electronic Appliance

The display device as described above according to the present disclosure can be used as a display unit (display device) of an electronic appliance in all fields in which an image signal input to the electronic appliance or an image signal generated in the electronic appliance is displayed as an image or a picture.

As can be seen from the above-described embodiments, the display device according to the present disclosure has the characteristic that it can realize the FRC driving while reducing the screen flickering in the change timing of the bits of the gradation data. Accordingly, by using the display device according to the present disclosure as the display unit, the electronic appliance in all fields can realize image display having a large number of display gradations in a state where the screen flickering is not outstanding.

The electronic appliance that uses the display device according to the present disclosure as its display unit may be, for example, a digital camera, a video camera, a game machine, a note type personal computer, or the like. In particular, the display device according to the present disclosure is suitable to be used as the display unit in the electronic appliance, such as a portable information appliance, such as an electronic book appliance or an electronic watch, or a portable communication appliance, such as a portable phone or a PDA (Personal Digital Assistant).

5. Configuration of the Present Disclosure

The present disclosure may take the following configurations.

(1) A display device in which pixels having a memory function are arranged, including:

a driving unit that performs display driving in a driving method that obtains a middle gradation by temporally changing gradation of each of the pixels in one period in which a plurality of frames are assumed, wherein the driving unit is configured to discontinuously write lower bits and higher bits of gradation data with respect to the pixels in a scanning direction in a unit of one line or a plurality of lines.

(2) The display device as described in (1), wherein the driving unit inserts writing of other data of the lower bits and the higher bits before finishing writing of entire lines with respect to one side of data of the lower bits and the higher bits.

(3) The display device as described in (2), wherein the driving unit performs writing of the one side of data of the lower bits and the higher bits by interlaced scanning in a unit of one line or a plurality of lines, performs writing of other data of the lower bits and the higher bits by interlaced scanning with respect to the same lines as the one side of data, and then sequentially performs writing of the one side of data and other data by interlaced scanning with respect to the lines interlaced by an initial writing.

(4) The display device as described in (1), wherein the driving unit performs discontinuous writing of one side of data of the lower bits and the higher bits in a certain frame in the scanning direction, and performs discontinuous writing of other data of the lower bits and the higher bits in a next frame in the scanning direction.

(5) The display device as described in (4), wherein the driving unit first performs writing of the respective data of the lower bits and the higher bits in one frame by interlaced scanning with respect to an odd-numbered line or an odd numbered-line group, and then performs writing by interlaced scanning with respect to an even-numbered line or an even-numbered line group.

(6) The display device as described in any one of (1) to (5), wherein the pixel includes a plurality of sub-pixels, and the gradation is displayed by a combination of areas of the plurality of sub-pixels.

(7) The display device as described in (6), wherein a pixel electrode of the pixel is divided into a plurality of electrodes for the plurality of sub-pixels, and the gradation display is performed by a combination of areas of the plurality of electrodes.

(8) The display device as described in (7), wherein the plurality of electrodes include three electrodes, and the gradation display is performed by a combination of areas of the middle electrode and the two electrodes across the middle electrode.

(9) The display device as described in (8), wherein the two electrodes have the same area.

(10) The display device as described in (8), wherein the two electrodes are electrically connected to each other and are driven by one driving circuit.

(11) A method of driving a display device in which pixels having a memory function are arranged and which performs display driving in a driving method that obtains a middle gradation by temporally changing gradation of each of the pixels in one period in which a plurality of frames are assumed, the method including:

discontinuously writing lower bits and higher bits of gradation data with respect to the pixels in a scanning direction in a unit of one line or a plurality of lines.

(12) An electronic appliance including:

a display device in which pixels having a memory function are arranged and which includes a driving unit that performs display driving in a driving method that obtains a middle gradation by temporally changing gradation of each of the pixels in one period in which a plurality of frames are assumed, wherein the display device discontinuously writes lower bits and higher bits of gradation data with respect to the pixels in a scanning direction in a unit of one line or a plurality of lines.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device in which pixels having a memory function are arranged, comprising:

a driving unit that performs display driving in a driving method that obtains a middle gradation by temporally changing gradation of each of the pixels in one period in which a plurality of frames are assumed, wherein the driving unit is configured to discontinuously write lower bits and higher bits of gradation data with respect to the pixels in a scanning direction, where the discontinuities exist between scanning units including one scanning line or scanning units including a plurality of scanning lines.

2. The display device according to claim 1, wherein the driving unit inserts writing of other data of the lower bits and the higher bits before finishing writing of entire lines with respect to one side of data of the lower bits and the higher bits.

3. The display device according to claim 2, wherein the driving unit performs writing of the data of the lower bits and the higher bits by interlaced scanning in a unit of one line or a plurality of lines, performs writing of other data of the lower bits and the higher bits by interlaced scanning with respect to the same lines as the one side of data, and then sequentially performs writing of the one side of data and other data by interlaced scanning with respect to the lines interlaced by an initial writing.

4. The display device according to claim 1, wherein the driving unit performs discontinuous writing of one side of data of the lower bits and the higher bits in a certain frame in the scanning direction, and performs discontinuous writing of other data of the lower bits and the higher bits in a next frame in the scanning direction.

5. The display device according to claim 4, wherein the driving unit first performs writing of the respective data of the lower bits and the higher bits in one frame by interlaced scanning with respect to an odd-numbered line or an odd numbered-line group, and then performs writing by interlaced scanning with respect to an even-numbered line or an even-numbered line group.

6. The display device according to claim 1, wherein the pixel includes a plurality of sub-pixels, and the gradation is displayed by a combination of areas of the plurality of sub-pixels.

7. The display device according to claim 6, wherein a pixel electrode of the pixel is divided into a plurality of electrodes for the plurality of sub-pixels, and the gradation display is performed by a combination of areas of the plurality of electrodes.

8. The display device according to claim 7, wherein the plurality of electrodes include three electrodes, and the gradation display is performed by a combination of areas of the middle electrode and the two electrodes across the middle electrode.

9. The display device according to claim 8, wherein the two electrodes have the same area.

10. The display device according to claim 8, wherein the two electrodes are electrically connected to each other and are driven by one driving circuit.

11. A method of driving a display device in which pixels having a memory function are arranged and which performs display driving in a driving method that obtains a middle gradation by temporally changing gradation of each of the pixels in one period in which a plurality of frames are assumed, the method comprising:

discontinuously writing lower bits and higher bits of gradation data with respect to the pixels in a scanning direction, where the discontinuities exist between scanning units including one scanning line or scanning units including a plurality of scanning lines.

12. An electronic appliance comprising:

a display device in which pixels having a memory function are arranged and which includes a driving unit that performs display driving in a driving method that obtains a middle gradation by temporally changing gradation of each of the pixels in one period in which a plurality of frames are assumed, wherein the display device discontinuously writes lower bits and higher bits of gradation data with respect to the pixels in a scanning direction, where the discontinuities exist between scanning units including one scanning line or scanning units including a plurality of scanning lines.

* * * * *